United States Patent [19]

Leduc

[11] 4,116,305

[45] Sep. 26, 1978

[54] MECHANICAL ROBE GRAB

[75] Inventor: Arthur J. Leduc, Sarnia, Canada

[73] Assignee: Leduc Safety Basket Corporation, Ontario, Canada

[21] Appl. No.: 814,661

[22] Filed: Jul. 11, 1977

Related U.S. Application Data

[63] Continuation-in-part of Ser. No. 742,279, Nov. 16, 1976, abandoned.

[51] Int. Cl.[2] ..... A62B 35/00

[52] U.S. Cl. ..... 182/3; 188/65.1

[58] Field of Search ..... 182/3–10, 182/191; 188/65.1, 65.2

[56] References Cited

U.S. PATENT DOCUMENTS

| | | | |
|---|---|---|---|
| 1,127,832 | 2/1915 | Voigt | 182/3 |
| 2,172,094 | 9/1939 | Voigt | 182/3 |
| 2,684,875 | 7/1954 | Kircher | 182/3 |

*Primary Examiner*—Reinaldo P. Machado

*Attorney, Agent, or Firm*—Wigman & Cohen

[57] ABSTRACT

The unitary rope grap disclosed is used as an arresting device in co-operation with a lifeline, which is adapted to pass through the rope grab. One end of the lifeline is affixed to an elevated position. A safety line attached to the worker is also attached to the rope grab and, when the worker falls from his elevation, this trips the rope grab to rigidly secure the rope grab to the lifeline and hence arrest the worker from further fall via the connection of the safety line between the worker and the rope grab. This is achieved by the rope grab having an essentially jaw-like frame which defines a throat with distal and proximate regions whereby the proximate region has a larger cross section then the cross section of the distal region, and the lifeline, which passes through the throat, has a cross sectional area larger than the proximate region but generally smaller than the distal region. During the engagement process, the rope migrates from the distal region of the throat to the proximate region to fixedly secure the rope grab to the lifeline; thereupon the falling worker is arrested.

10 Claims, 12 Drawing Figures

MECHANICAL ROBE GRAB

CROSS REFERENCE TO RELATED APPLICATION

This is a continuation-in-part application of Ser. No. 742,279, filed Nov. 16, 1976, now abandoned.

BACKGROUND OF THE INVENTION

This invention relates to a safety device for workmen when working with safety belts, lanyards and lifelines.

The construction industry, Workmen Compensation Boards and the construction unions have been unhappy with existing safety devices used by workmen at elevated heights.

In 1975 the Construction Safety Association of Ontario, Canada commenced a study of "Current Research of Safety Belts, Lanyards and Lifelines, " Research Report No. 30 of The Research and Development Department. That report has analysed the safety needs of the modern worker and has also reviewed the existing safety devices associated with safety belts, lanyards and lifelines. This particular report continues earlier work done for the Construction Safety Association of Ontario in a 1973 report on "Rope-Grabbing Devices" complied by W. R. Symones P. Eng.

ADVANTAGES AND SUMMARY OF THE INVENTION

My invention is a rope grab which obviates some of the more frequent complaints of earlier devices in that:

(a) there are no moving mechanical parts which need adjustment;

(b) it is light weight and simple to operate while providing positive grab of the rope (lifeline) when emergency arises;

(c) in its ready position, it may be simply repositioned on the lifeline and the device will stay there in its ready position awaiting tripping;

(d) the device is actuated to grab the lifeline within 18 inches of fall by a workman, thus stopping a workman in his fall before he has either accelerated sufficiently that any arrest of the falling workman would otherwise occasion trauma to his body and likely fracture the waist or rib cage, or has traveled too far in his fall as to be impacted on an object below him.

The invention thus contemplates a rope grab for use as an arresting device in co-operation with a rope as a lifeline which passes through the rope grab to a worker, and a safety line attached between the rope grab and the worker, the rope grab comprising:

(a) a collar defining an axis;

(b) a jaw-like frame, defining a throat with distal and proximate regions, whereby the throat extends from the margin of the collar as two fingers, diverging from an intersection and medially bent in the same direction and with their respective distal ends joined whereby the fingers define the throat, with its distal throat region intersecting the prolongation of the axis and having a larger cross sectional area than its proximate throat region, which is bounded by the collar and the proximate ends of the finger-like members; and, (c) means for attaching near the distal end a safety line whereby the lifeline extending through the collar and throat will normally assume a position relatively coincident to the axis and its prolongation and hence extend through the distal throat region, but when tension is applied via the safety line to the distal end, the grab pivots and wedges the rope between the finger-like members in the proximate throat region.

The invention also contemplates additional means located in the collar to urge the lifeline slightly against the collar and thereby provide sufficient friction between collar and lifeline so that the weight of the rope grab will not cause the rope grab to self migrate down the lifeline.

In another embodiment the invention, includes means by which the rope grab, positively grasps the lifeline at the collar. The rope grab includes a movable spike for penetrating the lifeline, biasing means for constraining the spike away from the lifeline, in the vicinity of the collar, and means for moving the movable spike into penetrating engagement with the lifeline in the vicinity of the collar whereby the lifeline is held in a fixed relation with the grab duirng the time that the spike is in penetrating engagement.

There is yet another further embodiment of the invention. It includes means that constrains the lifeline in the distal portion of the throat region when the grab is not activated by a falling workman. Such means includes a circumscribing resilient band which loosely encircles the lifeline and places the lifeline into a juxtaposed position with its closing cross member. Hence, it locates the lifeline in the distal throat region. With the lifeline in the distal throat region, the worker may more easily move (slide) the grab up and down the lifeline as the worker himself changes his elevation on the job as may be required. At the same time, the structure permits the ready location of the lifeline from the distal throat region into the proximate throat region in the manner as will be shortly described.

BRIEF DESCRIPTION OF THE DRAWINGS

The invention will now be described by way of example and reference to the accompanying drawings in which.

DETAILED DESCRIPTION OF PREFERRED EMBODIMENTS

Figure 1:
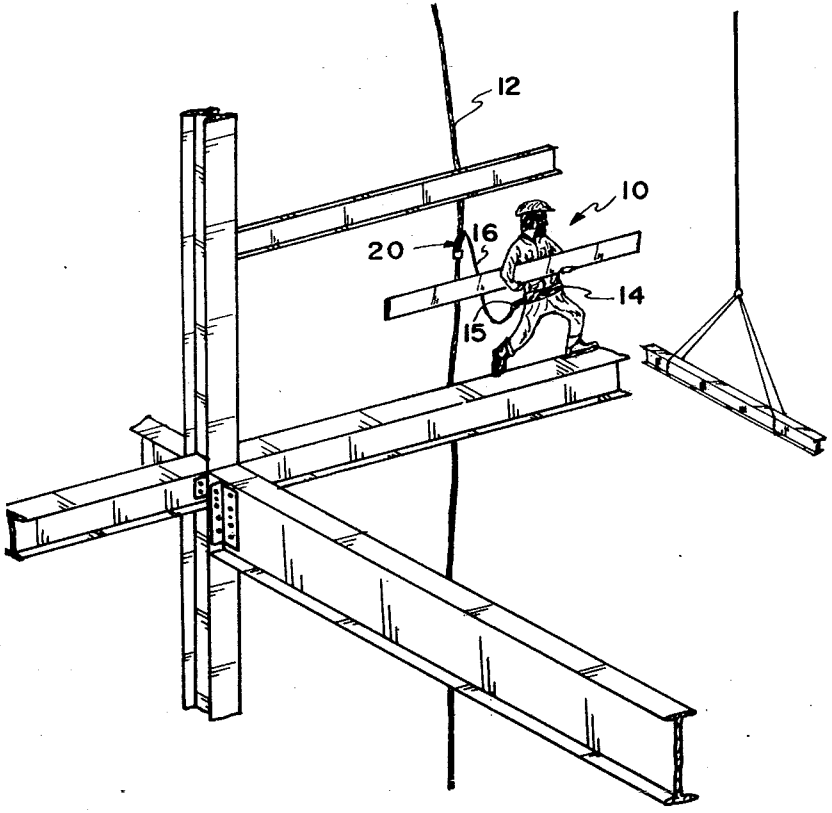
FIG. 1 shows a workman working at elevated heights employing the embodiments of the invention.

Referring to FIG. 1, a workman 10, for example a steel worker, is at elevated heights on the steel frame of a building. About his waist is a safety belt 14 which is affixed through a D ring 15 to his safety line 16 which in turn is attached at the other end to the rope grab 20 loosely secured to a lifeline 12. The lifeline 12 usually extends from the end of a crane boom, or from a higher location in elevation, downward to the ground.

Figure 2:
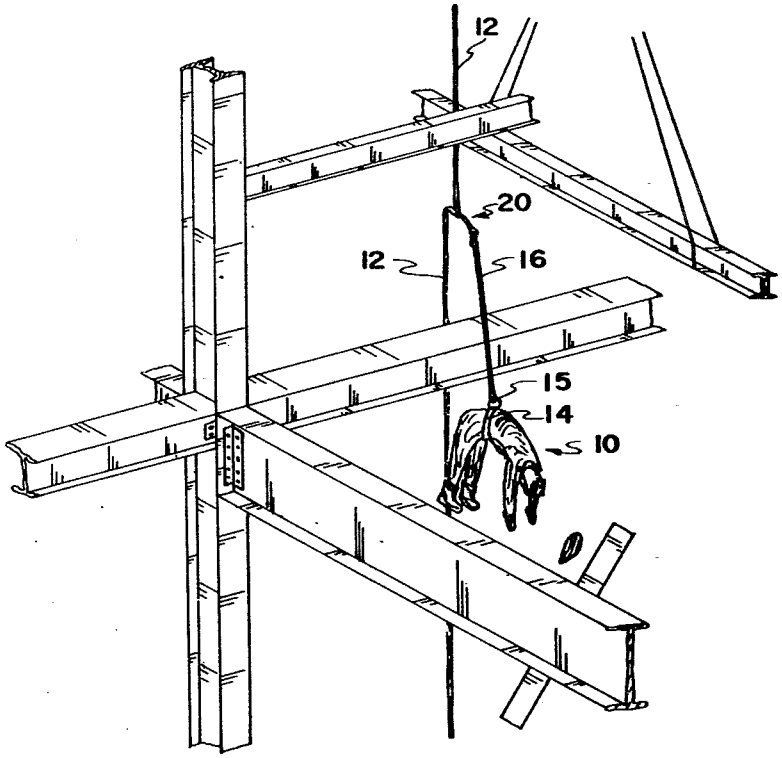
FIG. 2 shows the workman having fallen from his work position but secured to his lifeline by the embodiments of the invention.

If the workman should fall, as at FIG. 2, the rope grab will be tripped by the tension provided on the safety line 16 as a result of the change of elevation of the workman.

Referring to FIGS. 3 through 6, the rope grab 20 is composed of a collar 23 from which extends a jaw-like frame 21, composed of two finger-like members 22 whose distal ends are closed by member 24. The members 22 are in fact slightly dog legged, as seen clearly in FIGS. 3, 4 and 6. The members 22 and member 24 define thereby a wedged shaped throat region 30 wherein its distal region 31 is of a larger cross sectional area than the proximate region 32 and such that, due to the extent of the dog legs, the distal throat region 31 extends through the prolongation of the axis 26 of the collar 23. Preferably a D region 25 is provided beyond the member 24 by which, via a bias clip 17, the opposite end of the safety line 16 may be affixed to the rope grab 20. Within the collar, in order to increase the frictional relationship between the lifeline 12 and the collar 23, a spring wire frame 28 is secured by set screw 29 and forms an essentially horse-shoe spring arrangement. The lifeline 12 when extending through the collar 23 relatively displaces the horse-shoe spring members further apart from one another (since they straddle the lifeline 12), and they in turn provide a sufficiently strong urging force on the lifeline against the collar so as to provide the necessary friction such that the forces of gravity on the rope grab 20 will not cause the rope grab to self-migrate down the lifeline when the rope grab is in its rest position as at FIG. 1.

Figure 4:
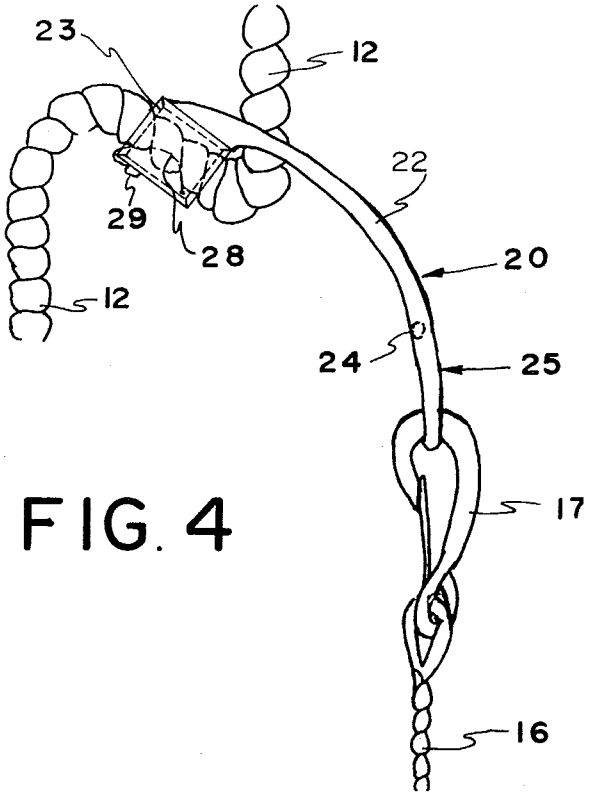
FIG. 4 shows the rope grab in its activated position (as in FIG. 2).
Figure 3:
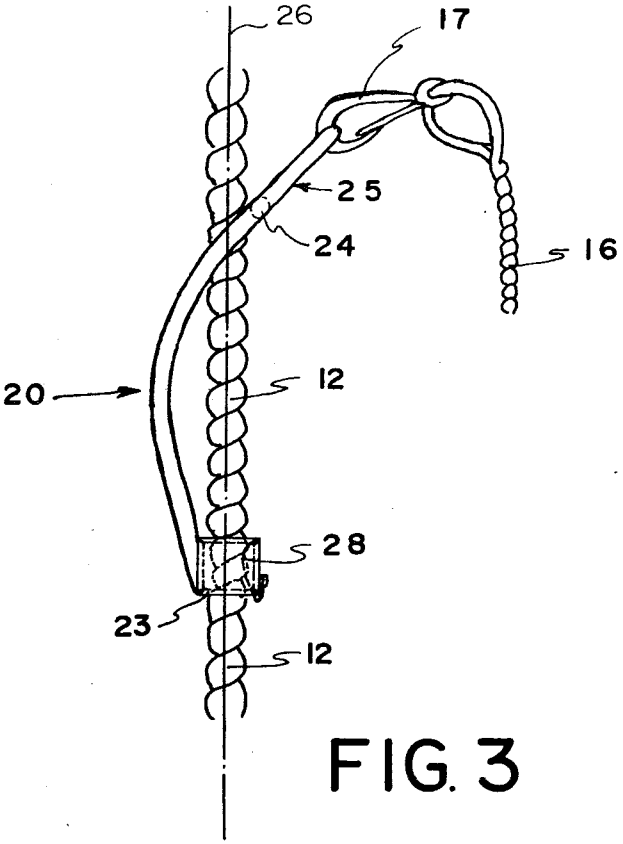
FIG. 3 is an exploded side view showing the rope grab in its normal rest position (as in FIG. 1).
Figure 5:
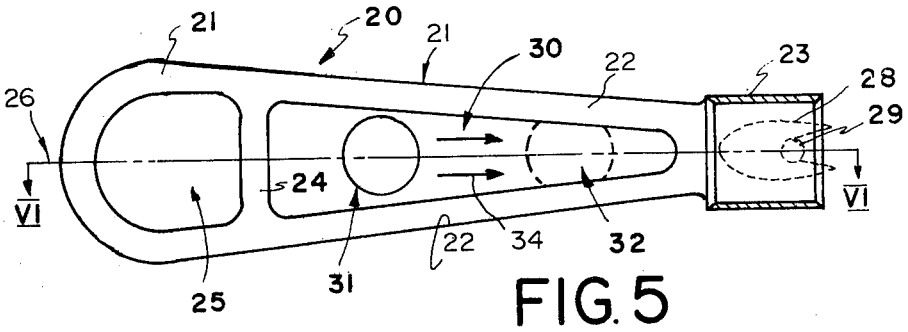
FIG. 5 is a plan view of the rope grab.
Figure 7:
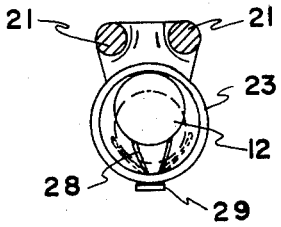
FIG. 7 is a section along line VII—VII of FIG. 6.
Figure 6:
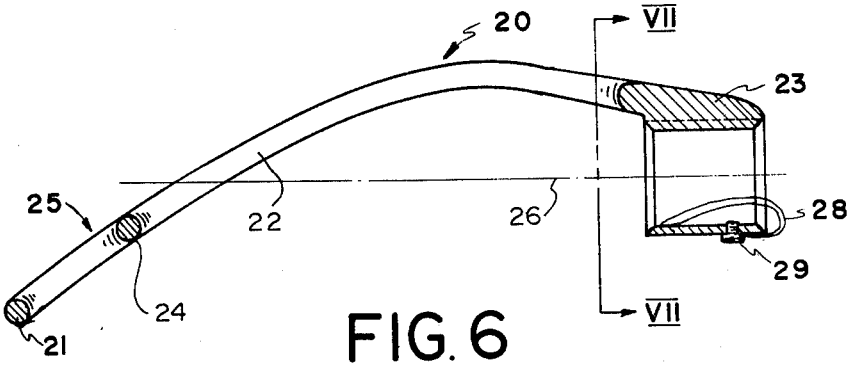
FIG. 6 is a section along line VI—VI of FIG. 5.

In operation, when no tension is applied by the safety line 16 on the rope grab, the rope grab assumes its vertical position of FIG. 3. When the workman falls, as at FIG. 2, from his elevated working position, the vertical displacement of the worker pulls his safety line 16 and hence trips the rope grab 20 into the configuration of FIG. 4. This causes the lifeline to assume an "S" form through the collar and proximate throat region 32. Referring to FIG. 5, the cross section of the rope 12 is larger than the internal distance between the finger-like members 22 in the proximate throat region 32 and hence the lifeline binds against them. From the rest position of FIG. 3 to the lifeline holding position of FIG. 4, the lifeline 12 will have migrated through the throat following arrows 34 from the distal throat region 31 to the proximate throat region 32.

I prefer to construct the rope grab (save and except the wire horse-shoe spring 28 and retaining set screw 29) from a unitary piece of steel which may be cast. In that mode, the finger-like members 22 extend beyond the distal connection member 24 and merge into a loop to create the D ring region 25.

I have further found that the diameter of the lifeline 12 should be smaller than the cross sectional area of the distal throat region 31 and larger than the proximate throat region 32, although the relative relationships are not precise. I have found that if the lifeline 12 is composed of several large twisted cord-like strands, such that the profile of the lifeline has a helical-like rib, and the finger-like members 22 have a diameter slightly less than that of the strands from which the rope is composed, the lifeline will more effectively lodge in the proximate throat region. This is because each finger-like member will straddle or more particularly intercede between two adjacently twisted strands. Thus, the proximate throat region should be about one-half an inch (1.25 cm) in cross section, while the lifeline rope diameter should be slightly larger than that, say about three-quarter of an inch (1.9 cm).

Figure 9A:
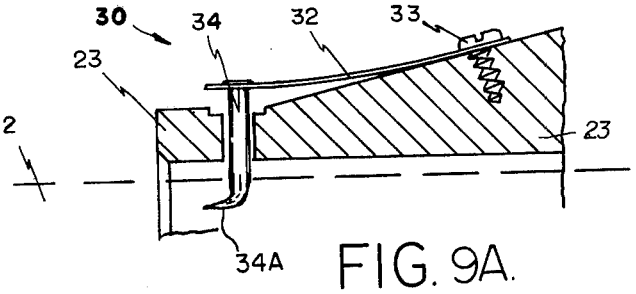
FIG. 9A is an enlarged sectional view, of a portion of a modified grab of FIG. 9.
Figure 9:
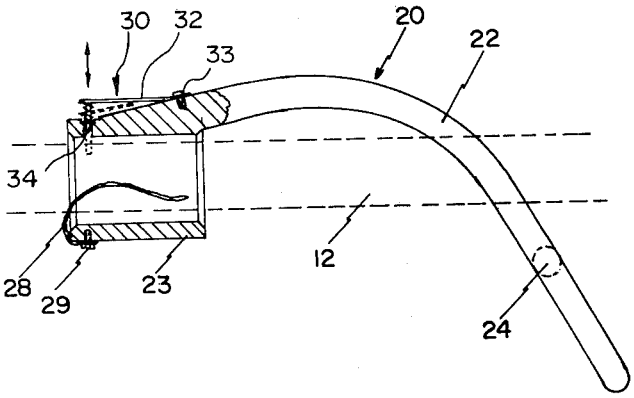
FIG. 9 is an elevational view, partially in section, of the grab of FIG. 8.
Figure 8:
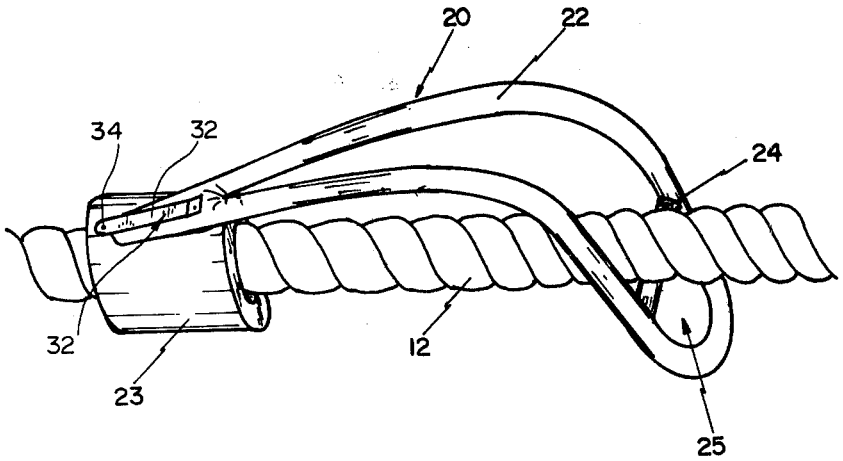
FIG. 8 is a perspective view, partially in section, of an alternative embodiment.

In the embodiments of FIGS. 8 and 9 a spring loaded spike device 30 is mounted at the collar 23. Device 30 includes a leaf spring 32 with one end attached to the collar as by a rivet or screw 33. The other end of the spring 32 constrains a penetrating spike 34 which extends into an aperatue formed through the collar 23. A small coil spring 36 is preferably positioned between collar and leaf spring 23 to surround a portion of the spike.

By depressing the leaf spring, the spike 34 is driven through the aperture into the underlying lifeline 12 and a positive engagement between lifeline and rope grab is maintained. The reasons for such device are now explained.

It has been found that workmen, who are in the process of falling, when using the grab, attempt to make efforts to grab the grab with their hands and thus to attempt themselves to arrest their fall by grabbing the lifeline or grab. If their attempt fails, which is preferred, the grab functions as previously described to arrest the worker from falling as by pivoting and causing the lifeline to migrate from the distal throat region as shown in FIG. 3 to the proximate throat region as shown in FIG. 4. If, on the other hand, the worker is successful and grabs the grab before the grab has had time to pivot and thus fully operate, the lifeline is prevented from engaging the proximate throat region since the worker himself has prevented the grab from operating. If the worker does not grab the lifeline but only grabs the grab then the grab prevents the worker from grabbing the lifeline, but the grab will slip along the lifeline, downwards, (since the grab will be held inoperative by the workman). The workman will fall and perish. On the other hand, with the spring loaded spike device of the embodiments of FIGS. 8 & 9, when the workman grabs the grab, he will of necessity grab the collar and hence force the leaf spring to drive the spike into the lifeline. This will arrrest the grab from sliding down the lifeline, since the spike is engaged into the lifeline, even though the grab is thereby prevented from operating normally by the grasping of the grab by the workman. If, and when, the workman lets go of the grab, of course, the grab will become operative again and pivot into its conventional constraining position (FIG. 4) in the manner earlier described.

Alternatively, referring to FIG. 9A, the spike 34 may have its tip bent as at 34A away from the throat region. The bent tip 34A then acts as, not only a penetrating tip into the lifeline, but also tends to feed itself into the lifeline 12 for positive grip and anchoring of the spike 34, during the very initial stages of workman fall, as explained in the preceeding paragraph.

Figure 11:
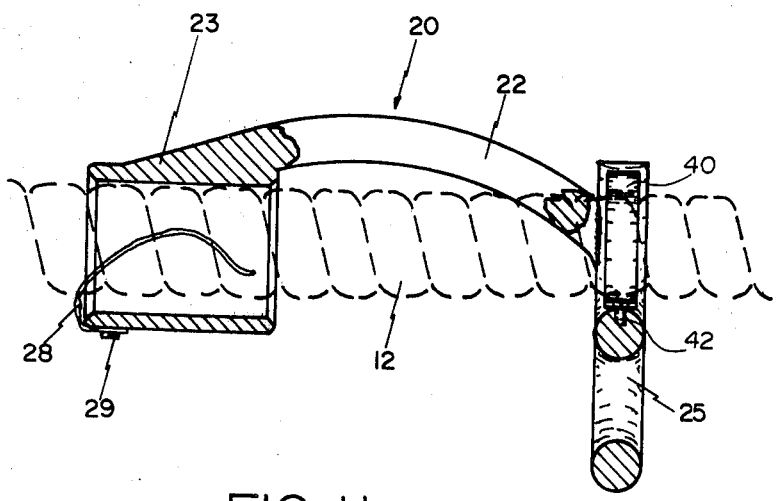
FIG. 11 is an elevation, partially in section, of the grab of FIG. 10, but without the swivel safety catch.
Figure 10:
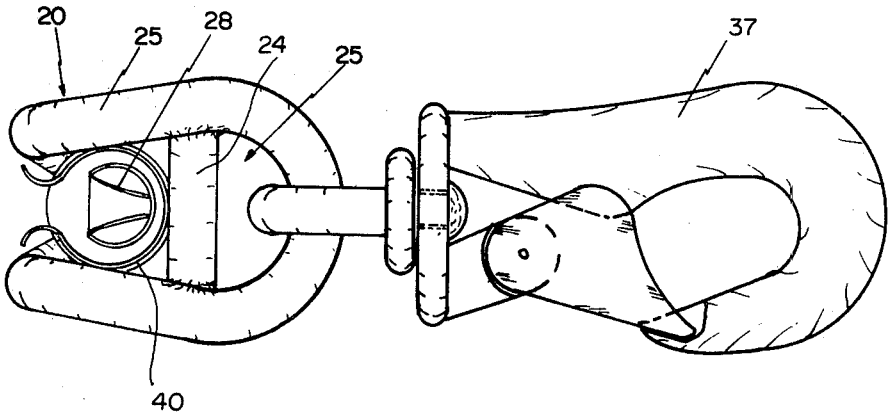
FIG. 10 is an end view of a further embodiment with a further addition, namely a modified swivel safety catch attached to the D region.

Referring to FIGS. 10 and 11, and yet another embodiment of the invention, the grab 20 is conventionally constructed as earlier described. To the inside of the distal throat region, however, there is attached a C shaped resilient band or spring 40 which defines a central region. The spring has an open segment disposed away from the D region 25. Typically, the C spring 40 is attached at its base by a rivet 42 into the cross member 24. The tips of the open C spring are curved back as shown in FIG. 10 and provide a passage through which the lifeline may pass while springing back the tips away from each other. The open center, or central region, of the C spring is sized to accommodate the full diameter of the lifeline while the open segment, the passage between the curved back tips, is smaller. Thus the lifeline is normally held in the open centre but may freely pass through the passage when required.

It will now be appreciated, that with this embodiment, the lifeline will be held by the C spring in the distal throat region when normal working conditions exist (ie. the lifeline assumes the position akin to that of FIG. 3). Otherwise, when tripping of the grab occurs, the lifeline will easily pass out of the open center of the C spring, through the passage, into engagement with the divergent fingers in the proximate throat region. The grab will then assume the position akin to FIG. 4 and of course arrest the falling worker in the manner earlier described.

In any of the embodiments disclosed it may be further convenient to attach the D region to a swivel safety catch as illustratively shown in FIG. 10. The swivel safety catch 37 has the advantage that it does inhibit, to some degree, conventional twisting of the lifeline and safety line, thereby, the likelihood of line fouling is reduced.

I claim:

1. A rope grab for use as an arresting device in cooperation with a rope as a lifeline which passes through the rope grab to a worker, and a safety line attached between the rope grab and the worker, the rope grab comprising:

(a) a collar defining an axis;

(b) a jaw-like frame, defining a throat with distal and proximate regions, whereby the throat extends from the margin of the collar as two fingers, diverging from an intersection and medially bent in the same direction and with their respective distal ends joined whereby the fingers define the throat, with its distal throat region intersecting the prolongation of the axis and having a larger cross sectional area than its proximate throat region, which is bounded by the collar and the proximate ends of the finger-like members; and, (c) means for attaching near the distal end a safety line whereby the lifeline extending through the collar and throat will normally assume a position relatively co-incident to the axis and its prolongation and hence extend through the distal throat region, but when tension is applied via the safety line to the distal end, the grab pivots and wedges the rope between the finger-like members in the proximate throat region.

2. The rope grab as claimed in claim 1 wherein means (c) is formed by the prolongation of the finger-like members, beyond the distal throat region to define there an aperture bounded by the prolongations, that bend to unite into a loop as an extension, beyond the distal throat region, whereby the safety line may be attached to the loop extension.

3. The rope grab as claimed in claim 1 wherein the bias means is housed within the collar and is adapted to urge the lifeline against the collar.

4. The rope grab as claimed in claim 1 wherein the cross sectional area of the lifeline is smaller than that of the distal throat region.

5. The rope grab is claimed in claim 1 including means for loosely constraining the lifeline in the distal throat region.

6. The rope grab is claimed in claim 1 including a resilient C shaped member, with ends, the C shaped member defining a central region, while its ends define an open segment, through which the lifeline may pass into or out of the central region, means for attaching the C shaped member to a margin of one finger in the distal throat region so as to dispose the open segment in a more proximate relation with the proximate throat region than with the central region.

7. The rope grab is claimed in claim 1 including a resilient C shaped member with ends, the C shaped member defining a central region while its ends define an open segment, through which the lifeline may pass into or out of the central region, means for attaching the C shaped member to a margin of one finger in the distal throat region so as to dispose the central region coincident with the axis and the open segment in a more proximate relation with the proximate throat region than with the central region.

8. The rope grab as claimed in claim 1 including a movable spike for penetrating the lifeline, biasing means for constraining the spike away from the lifeline in the vicinity of the collar, and means for moving the movable spike into penetrating engagement with the lifeline in the vicinity of the collar so as to constrain the lifeline to the grab.

9. The grab as claimed in claim 1 wherein an aperture is defined by and extends through the collar, a movable spike adapted to move through the aperature into penetrating engagement with the underlying lifeline, biasing means for constraining the spike away from the lifeline, and means for moving the movable spike into penetrating engagement with the lifeline whereby the lifeline is held in a fixed relation with the grab.

10. The grab as claimed in claim 9 wherein the spike has a tip which is curved to depend away from the throat region.

* * * * *